United States Patent [19]

Connelly, Jr.

[11] 4,222,886

[45] Sep. 16, 1980

[54] PUMPABLE PIPE CLEANING COMPOSITION

[76] Inventor: George F. Connelly, Jr., Golf Rd. and Perkins Blvd., Grand Beach, Mich. 49117

[21] Appl. No.: 935,538

[22] Filed: Aug. 21, 1978

Related U.S. Application Data

[63] Continuation-in-part of Ser. No. 799,282, May 23, 1977, abandoned, which is a continuation-in-part of Ser. No. 593,037, Jul. 3, 1975, Pat. No. 4,025,359, which is a continuation-in-part of Ser. No. 456,468, Apr. 1, 1974, Pat. No. 3,969,255.

[51] Int. Cl.[2] ..... C23G 1/06

[52] U.S. Cl. ..... 252/149; 134/3; 134/22 R; 134/22 C; 252/82; 252/87; 252/181; 252/148; 422/12; 422/16

[58] Field of Search ..... 252/148, 149, 82, 87, 252/181; 134/3, 22 R, 22 C; 422/12, 16

[56] References Cited

U.S. PATENT DOCUMENTS

| | | | |
|---|---|---|---|
| 3,113,113 | 12/1963 | Marsh et al. | 252/148 X |
| 3,766,077 | 10/1973 | Hwa et al. | 252/181 X |
| 3,907,699 | 9/1975 | Blair | 252/149 |
| 3,969,255 | 7/1976 | Connelly, Jr. | 282/87 |
| 4,025,359 | 5/1977 | Connelly, Jr. | 282/87 X |

OTHER PUBLICATIONS

G. E. Silicones "Silicone Antifoams" prior-1969 pp. 8, 9.

*Primary Examiner*—Mayer Weinblatt
*Attorney, Agent, or Firm*—Cook, Wetzel & Egar, Ltd.

[57] ABSTRACT

A pipe cleaning composition containing hydrochloric acid, at least one nitrogen-based inhibitor, a solubilizer for said inhibitor, a polysiloxane anti-foam agent and water, has a reduced tendency to attack copper or steel pipe.

10 Claims, No Drawings

PUMPABLE PIPE CLEANING COMPOSITION

The present invention is a continuation-in-part of copending application Ser. No. 799,282 filed May 23, 1977 now abandoned, which in turn is a continuation in part of Ser. No. 593,037 filed July 3, 1975, now U.S. Pat. No. 4,025,359, which in turn is a continuation-in-part of application Ser. No. 456,468 filed Apr. 1, 1974, now U.S. Pat. No. 3,969,255.

The present invention relates to the removal of scale from metal surfaces, and especially to the removal of scale comprising metal oxides and carbonates from interior of galvanized, steel or copper pipes and other galvanized, steel or copper vessels employed for the transport or storage of aqueous fluids. More particularly, the present invention relates to an improved composition for removing scale from such metal surfaces which composition has a reduced tendency to attack the zinc, copper or steel, and is particularly adaptable to the cleaning of scale from the galvanized pipes of potable water systems.

Formation of scale on the interior surfaces of pipes, tubes, coils, tanks, heat exchangers, and other vessels has been a source of trouble where such pipes or vessels come in contact with aqueous liquid. The formation or deposition of scale markedly reduces the heat transfer through walls of such pipes or vessels and furthermore, the capacity of the pipes or vessels and the passage of fluids therethrough is restricted by the formation of such scale. Because of the scale formation on the inner surfaces of the pipes, particularly in the heat transfer appliances, pipes are subjected to excessive heat due to the loss in heat transfer capacity. Further, greater pressure is required to overcome the restricting effect of the deposited scale. These disadvantages often lead to leaks and rupture which necessitate undesirable down time and maintenance cost. Still further, the reduced cross-section of pipes caused by the deposition of scale can cause increased pressure drop, wherein the water pressure at the top of a multi-story building will approach zero.

Numerous attempts have been made to remove scale containing metal oxides and carbonates from the interior of galvanized, copper or steel pipes or fluid confining vessels. The more successful attempts have consisted of using aqueous solutions of known solvents for the compounds commonly found in the scale such as $Fe_2O_3$ and FeS, in combination with acidic materials which can react with the calcium carbonate and calcium oxide which comprises the balance of the scale. The use of hydrochloric acid solutions in concentration from about 1 to 25%, the balance being water, have been proposed, but such aqueous solutions usually lead to serious corrosion problems with respect to the galvanized, steel or copper pipes or water-confining vessels.

Strong acid solutions have been proposed by the prior art to dissolve scale, particularly calcium carbonate scale which is deposited on cooling towers and the metal surfaces of other systems and equipment for handling water. Such systems are designed to handle circulating water for cooling purposes, among other things, and in order to clean the systems the acid cleaning solutions generally must be circulated. The circulation causes aeration of the acid solutions which renders most prior art corrosion inhibitors virtually ineffective.

Applicant's U.S. Pat. Nos. 3,969,255 and 4,025,359 describe useful and effective corrosion inhibition systems suitable for use with hydrochloric acid solutions. Those prior applications suggest that the corrosion inhibition systems therein described may be supplemented with other materials, including nitrogen-based inhibitors and in particular the inhibitors which are the reaction product of an acetylenic alcohol containing 10 carbon atoms with an amine selected from a group of primary and secondary amines and polymethylene diamines, of the type which are commercially available under the tradename "Armohib 28". While such supplemental inhibitors are effective in that they improve the corrosion inhibiting properties of the system, in order to use such inhibitors in a water-based system, it is essential to use a solubilizer therewith. Such solubilizers include polyoxyalkylated mono- and di-alkylene amines. Such nitrogen-based inhibitor systems are described in U.S. Pat. No. 3,113,113.

While the addition of nitrogen-based inhibitor systems described in U.S. Pat. No. 3,113,113 to the inhibitors described in applicant's U.S. Pat. No. 3,969,255 or to the inhibitors described in applicant's U.S. Pat. No. 4,025,35, increase the overall inhibiting effect, the addition of the nitrogen-based inhibitor system (including the solubilizer) creates a material with a high tencency to foam. When such acid solutions are brought in contact with the carbonate-based scale, a reaction occurs between the hydrochloric acid and the carbonates, which generates carbon dioxide and produces foam at the scale-acid interface. In cleaning out domestic potable water systems, this acid-carbonate reaction is a problem since the system tends to become filled with foam. In cleaning out water handling equipment, such as domestic potable water systems, it is usually necessary to pump the acid solution through the system. The incidence of foam causes problems with the pumping, in that the pumps tend to cavitate, and the foam tends to cause spilling and overflowing, particularly if the pipe cleaning composition is pumped into open containers. Still further, it has been observed that pumping of the solutions which have solubilized inhibitor systems therein tends to create foaming even before the added solution contacts the scale.

The present invention overcomes the foaming problem by adding an anti-foam agent to the inhibitor-acid solution, whereby the resulting pipe cleaning composition possesses the ability to attack and remove scale with superior acid inhibiting with respect to the attack of the metal pipe or equipment, and, at the same time, the present invention eliminates the formation of foam to the extent that the solution may be pumped using high capacity pumps, in the cleaning of domestic potable water systems.

U.S. Pat. No. 3,113,113 describes a class of amine-based inhibitors, which are the reaction product of an alkynol with aliphatic or alicyclic amine materials to produce inhibitors which require the use of solubilizing substances or agents. In particular, the solubilizers recommended by U.S. Pat. No. 3,113,113 are sold under the trademark ETHOMEEN and ETHODUOMEEN. Such solubilizers have the following general formula:

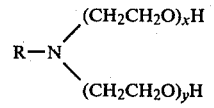

where R is an aliphatic hydrocarbon radical having from 8 to 22 carbon atoms and x and y are integers the sum of which may be between 2 and 50; and

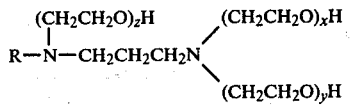

wherein R is an aliphatic hydrocarbon radical having between 8 and 22 carbon atoms and x, y, and z are integers the sum of which may be from 2 to 50. The presence of the solubilizers tend to influence the effectiveness of the corrosion inhibitor, the alkynol-aliphatic or alicyclic amine reaction product, but as is pointed out above, the resulting product has a severe tendency to foam.

It has been demonstrated that such solubilized inhibitor systems may be added to inhibitor systems described in applicant's prior applications, or may be used in lieu thereof, to produce safe and effective inhibitors for acid solutions to clean pipes containing carbonate-based scale. However, as is pointed out above, the solubilized inhibitors cause a severe foam problem which rendered the systems per se inoperative for the purpose of cleaning out domestic water systems.

The present invention contemplates a pipe cleaning composition which includes hydrochloric acid, a system of inhibitors which includes at least one solubilized inhibitor, and an anti-foaming agent, the balance of the composition being essentially water. More particularly, the present invention contemplates a pipe cleaning composition containing from about 7.5 to about 25% by weight of hydrochloric acid. While those skilled in the art will understand that hydrochloric acid is available in greater strength and that more concentrated compositions may be made up containing more concentrated hydrochloric acid, and suitable quantity of inhibitors, and anti-foam, it is contemplated that the best results will be achieved with respect to cleaning domestic water systems, if the working solution contains from about 7.5 to 25% by weight of hydrochloric acid. Lower quantities of acid, or more diluted solutions may be used, but they are not contemplated to be as effective as compositions wherein the hydrochloric acid concentration is within the desired range. In the preferred range, the most preferred acid level is about 10% by weight hydrochloric acid, based upon the entire pipe cleaning composition.

The preferred amine-based inhibitor for use in the present invention is a reaction product of an acetylenic alcohol and a primary or secondary amine, which is solubilized with a polyoxyalkylene amine solubilizing agent. Such amine-based inhibitors and solubilizing agents are described in U.S. Pat. No. 3,113,113. Such inhibitor systems are hereinafter referred to as solubilized inhibitors. For purposes of the present invention the solubilized inhibitor may be used as the sole inhibitor, or the solubilized inhibitor may be used with other inhibitors. When the preferred amine-based solubilized inhibitor is to comprise the sole inhibitor used in the pipe cleaning composition, it is generally preferred that the pipe cleaning composition contain from about 0.2 to about 5% by weight of the amine-based solubilized inhibitor, the exact amount depending upon the acid concentration. When, on the other hand, the preferred amine-based solubilized inhibitor is to be used in conjunction with the other inhibitors, the level of amine solubilized inhibitor will vary according to the level of the other inhibitors, but it is generally contemplated that the preferred amine-based solubilized inhibitor will vary between 0.05% and 2.5% when the other inhibitors are used at levels between about 1 and 5%.

Generally speaking the pipe cleaning compositions of the present invention may include various amounts of furfural, dialkylthiourea, and benzylthiocyanate as supplemental inhibitors. Such supplemental inhibitors may be used as taught in applicant's U.S. Pat. Nos. 3,969,255 and 4,025,359. It is contemplated that as little as 0.5% by weight of any of these supplemental inhibitors may be used and as much as 5% by weight, although the exact level used must be determined by the type of scale which is involved, type of pipe which is to be cleaned and to some extent the temperature at which the cleaning operation is to take place.

The present invention contemplates the use of a wide variety of anti-foam agents, which may be used singly or in combination. The preferred anti-foam agents comprise polydimethyl-siloxane having finely divided silica dispersed therein. Such anti-foaming agents are commercially available as an undiluted syrup and as water dilutable aqueous emulsions. Suitable anti-foam agents include Dow Corning Anti-foam A, Anti-foam AF, and Anti-foam B Emulsion, as well as General Electric Anti-foam Emulsion AF-60 and others. The amount of anti-foam agent required is dependent in part upon the level of the amine-based solubilized inhibitor used, and in part upon the level of other inhibitors which may be present. An effective amount of anti-foam agent is defined as sufficient to inhibit foaming to the extent that the pipe cleaning composition may be pumped and handled without excessive foaming.

For pipe cleaning compositions which employ an amine-based solubilized type of inhibitor as substantially the sole inhibitor, the anti-foam agent level should be from about 10% to 120% by weight of the weight of the amine-based solubilized inhibitor. In this embodiment, the acid level is preferably between about 7.5% by weight and 25% by weight, and the amine-based solubilized inhibitor level should be between 0.2 and 5.0% by weight of the composition, with the anti-foam agent level being between about 0.01 and 3.0% of the overall composition.

In pipe cleaning compositions which include inhibitors in addition to the amine-based solubilized inhibitor system, the anti-foam agent level may vary widely, but it is chiefly dependent upon the amount of the solubilized inhibitor used. It is postulated that the foam problem is principally a function of the solubilizing agent used to solubilize the solubilized inhibitor. However, it has been observed that the presence of other inhibitors such as furfural, diethylthiourea and/or benzylthiocyanate reduce the tendency of the solubilized inhibitors to foam and that in such systems the anti-foam agent should equal about 5% to about 120% by weight of the weight of the amine-based solubilized inhibitor. In other words, the ratio of solubilized inhibitor to anti-foam should be about 0.9:1 to 20:1, although lesser or greater quantities may be used if desired. Those skilled in the art will understand that the foam agents are relatively expensive, and therefore a minimum amount of anti-foam agent should be employed, consistent with the end result of reducing a foaming of the pipe cleaning composition.

Since the balance of the compositions is essentially water, those skilled in the art will be aware that various ratios of dilution can be used for different purposes, depending upon the type of pipe or water holding vessel which is being cleaned. While it may be desirable to manufacture the pipe cleaning compositions of the present invention at higher concentrations than those set out above, prior to use the compositions should be diluted to the specified levels for most effective use.

It has been found that the addition of inhibitors to levels higher than specified above tends to increase the cost of the pipe cleaning compositions without increasing the effectiveness of the composition. Further, furfural is oily and has a bad odor, and use of more than 2.6 parts by weight (on the basis given above) of furfural tends to cause a film insoluble material to be precipitated on the surface of the pipe being cleaned, which is particularly desirable in domestic water systems. For these reasons, the amount of furfural used in the pipe cleaning composition should be kept as low as possible.

The thioureas of various types are slow to dissolve under some conditions. Therefore the use of higher quantities of thiourea require longer mixing times in the manufacture of the pipe cleaning compositions, and add to the cost thereof without a measurable improvement in the compositions.

As is indicated above, the most effective inhibitor combinations must include a dialkylthiourea. It has been found that diethylthiourea produces the best results, although useful results have been achieved using dimethylthiourea, dibutylthiourea, and diisopropylthiourea. Those skilled in the art will be aware that other dialkylthioureas, similar thioureas such as diphenylthiourea and ethylenethiourea or materials which form such dialkylthioureas in the presence of water and acid may be used.

The preferred composition contemplated by the present invention for use in cleaning or removing scale from residential water systems is as follows:

| | | |
|---|---|---|
| Hydrochloric Acid (22° Baume) | 15 | gallons |
| furfural | 40 | oz |
| diethylthiourea | 42 | oz |
| benzylthiocyanate | 3.5 | oz |
| Armohib 28 | 20 | oz |
| Oil of cedarwood leaf | 2.5 | oz |
| GE AF-60 antifoam (30% active ingredient) | 12 | oz |
| Water | sufficient to make 55 gallons | |

The anti-foam material may be reduced to 8 oz in the foregoing formulation. Another useful pipe cleaning composition is as follows:

| | Percent by Weight | |
|---|---|---|
| HCl | about | 10.0 |
| solubilized inhibitor (Armohib 28) | about | 0.1 |
| fufural | about | 1.3 |
| diethylthiourea | about | 0.4 |
| anti-foam agent | about | 0.05 |
| water | | 87.9 |

In making up the compositions of the present invention, hydrochloric acid of various concentrations can be used, as will be known to those skilled in the art. The commercially available 37% hydrochloric acid has been found to be convenient. In making up the preferred composition, about 26.8 parts by weight of 37% hydrochloric acid are used with the described quantities of solubilized inhibitors, furfural, diethylthiourea, and anti-foam agent, the balance being essentially water. It has been found that this composition not only rapidly removes scale from the galvanized pipe of residential water systems, but is greatly improved over the prior art systems insofar as corrosion inhibition is concerned.

The pipe cleaning compositions of the present invention may be produced by mixing the compositions in any desired order. It has been found advantageous to mix the acid first with dialkylthiourea, followed by the addition of water. While this mixing step usually gives a clear solution, some dialkylthiocyanates produce a milky solution. The furfural is then added to the acid solution. The present invention contemplates the use of various mechanical devices for mixing, including high speed dispersers and the like.

The following examples will serve to illustrate the preparation of several pipe cleaning compositions within the scope of the present invention, but it is understood that these examples are set forth merely for illustrative purposes and many other pipe cleaning compositions are within the scope of the present invention.

EXAMPLE 1

Seven different solutions, identified below as Formulas No. 1 through 7, were prepared using the components described in Table 1. All formulas have the same concentration of hydrochloric acid and the same total inhibitor content (i.e., 2.10%) except for Formula No. 2 which had 1.84% total inhibitor. Formula No. 7, which contained only HCl in water, served as a "blank" or "control". Each of the other six formulas varied the identity of the inhibitor or inhibitor combination.

TABLE 1

| Formula No. | HCl 37% | Water | Furfural | Diethylthiourea | Benzyl thiocyanate | "Armohib 28" |
|---|---|---|---|---|---|---|
| 1 | 26.78 | 71.12 | 1.30 | 0.72 | 0.08 | — |
| 2 | " | 71.38 | 1.30 | 0.36 | 0.08 | 0.10 |
| 3 | " | " | — | 2.10 | — | — |
| 4 | " | " | — | 1.05 | — | 1.05 |
| 5 | " | " | — | 2.10 | 0 | — |
| 6 | " | " | — | — | 0 | 2.10 |
| 7 | " | 73.22 | — | — | — | — |

The formulas shown in Table 1 were tested by placing 10.0 grams of steel turnings into a flask of a modified Chittick gas evolution apparatus. The steel turnings were clean and uniform. They were cut into flakes to pass a USS 4 mesh sieve and be retained on 10 mesh. The thickness of the flakes was 0.095" to 0.010". The flakes were washed with chloroform to remove any traces of oils, machining compounds, etc. A single lot of these steel particles was prepared and portions of the same lot were used in all the tests. One hundred grams of the test formula were placed in the flask, and the volume of gas generated was noted at suitable time intervals. It was assumed that the rate of attack on steel is equivalent to the rate of hydrogen gas evolution. Thus, the lower the gas evolution rate, the more effective the inhibitor.

Table 2, below, shows the average rates of evolution of hydrogen over the first hour (estimated accuracy about 0.008 ml per minute) and the ranking of the compositions in terms of effectiveness in preventing hydrochloric acid from attacking steel. The volumes of gas have been corrected to standard temperature and pressure of 0° C. and 760 mm of mercury.

TABLE 2

| Formula No. | Hydrogen Evolution Rate | Rate Relative to No. 7 = 100 | Rank in Order of Effectiveness |
|---|---|---|---|
| 1 | 0.0200 ml/min | 0.339 | 2 |
| 2 | .0067 | .113 | 1 |
| 3 | .197 | 3.34 | 8 |
| 4 | .0833 | 1.41 | 6 |
| 5 | .0183 | 3.10 | 7 |
| 6 | .0300 | 0.508 | 3 |
| 7 | 5.90 | 100 | 12 |

EXAMPLE 2

A five gallon sample of a pipe cleaning composition is made up from the following materials:

| | |
|---|---|
| Hydrochloric acid (22° Baume) | 1.38 gal |
| Armohib 28 | 3.2 oz |
| Water | Balance |

This composition was circulated by pumping it from a 15 gallon container, through a pump and back into the container. Although no foam was generated initially, when a small amount of lime was added the composition foamed from 5 gallons to more than 15 gallons and overflowed the container, even with the pump circulating the composition.

One ounce of GE AF-60 antifoam emulsion (30% active ingredient) was added to the above-described system. The addition of a small amount of lime to the composition containing the anti-foam caused foaming, i.e., about 3 gallons of foam were formed above the 5 gallons of the composition, but when the composition was circulated with the pump the foam disappeared as a practical matter. This demonstrates that as little as 10% of the anti-foam agent, based on the weight of the Armohib 28 provides effective foam inhibition.

The compositions of the present invention are usable in the same manner as the various scale removal solutions of the prior art. This is generally accomplished by pumping the pipe cleaning solution through the pipes of the system being cleaned for an hour or more.

More particularly, in cleaning or descaling a residential water system, the water supply is shut off, and the water removed from the plumbing. A shower head is removed and capped at the highest point of the water system and by opening both the hot and cold valves on the capped shower, the pipe cleaning solution can be pumped up through the cold water system, whereupon it returns down through the hot water system or vice versa. The time of pumping will depend on the concentration of the acid in the pipe cleaning solution and is a function of the amount of scale actually present in the pipe. The actual technique by which this pipe cleaning solution is applied to the pipes is not critical with respect to the present invention although it is preferred to keep the time of contact as short as possible in order to minimize corrosion.

After the scale has been removed using the compositions of the present invention, it may be advisable to neutralize the cleaning pipe. After cleaning out domestic or residential water systems, it is necessary to thoroughly flush the acid and all inhibitors out of the system. In this regard, the present invention contemplates the use of neutralizing agents, baking soda, or the like to neutralize the acid.

In addition to cleaning out residential water systems, the pipe cleaning composition of the present invention is useful in cleaning out humidifiers, vaporizers, shower heads, tea kettles, steam tables, air conditioners and similar water handling apparatus which is susceptible to scale formation. In cleaning out systems which are not used for potable water, it may be desired to mix a small amount of the pipe cleaning solution of the present invention with the water therein in order to inhibit, reduce or eliminate the possibility of scale formation.

The solutions of the present invention may be diluted with water, if desired, for some purposes. It has been found that diluting the pipe cleaning solutions will increase the amount of cleaning solution to be pumped, which may be an advantage if insoluble scale is encountered. In such cases the pumping of the increased volume of pipe cleaning solution will tend to carry the insoluble materials through the pipes, where the solids may be removed by filtration or sedimentation from the pipe cleaning solution. Further, the present invention contemplates that auxiliary materials may be added to the pipe cleaning solutions, such as abrasives or odor absorbers. Still further, one or more organic solvents may be added to the pipe cleaning composition in order to keep one or more of the inhibitors in solution and to help remove or dissolve some of the scale residue.

The pipe cleaning compositions of the present invention are preferably used at ambient temperatures although they may be used at elevated temperatures, if desired. While the use of elevated temperatures increases the speed with which the pipe cleaning composition acts, the advantage of the increase in speed is offset by the cost and trouble involved heating the cleaning composition and the pipe through which it is pumped.

As used herein, the term "parts by weight" shall not necessarily equal the percent by weight, except wherein so stated. Due to the nature of the present invention, the compositions may be diluted to alter the inhibitors or acids outside of the specified ranges, if said ranges were construed as percentages. Since the amount of water used in connection with the pipe cleaning compositions of the present invention may vary considerably, the ratios are expressed in parts by weight.

The forms of invention herein shown and described are to be considered only as illustrative. It will be apparent to those skilled in the art that numerous modifications may be made therein without departure from the spirit of the invention or the scope of the appended claims.

I claim:

1. A composition for cleaning scale encrusted copper, steel or galvanized metal surfaces wherein said scale includes at least one alkaline earth metal carbonate, said composition consisting essential of:

an aqueous solution of from about 7.5 to 25 percent by weight of hydrochloric acid, a corrosion inhibiting amount of an inhibitor system including from about 0.05 to 5.0 percent by weight (based on the weight of the aqueous acid solution) of an amine-based inhibitor which is the reaction product of an acetylenic alcohol with a primary or a secondary amine, said amine-based inhibitor including a solubilizer selected from the group consisting of polyoxylated mono and diamines having the formulae:

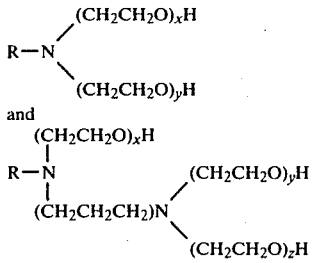

and wherein R is an aliphatic hydrocarbon radical having from 8 to 22 carbon atoms and x, y and z are integers, the sum of which is from 2 to 50, and;

an effective amount of a polydimethylsiloxane anti-foam agent, said siloxane having a viscosity of about 100 centistokes at 25° C.

2. A composition as described in claim 1 wherein the amine-based inhibitor is the reaction product of from 1 to 4 moles of the acetylenic alcohol containing from 3 to 10 carbon atoms with one mole of an amine selected from the group consisting of primary and secondary amine having the formulae:

$RNH_2$ and $RR'NH$ and substituted polymethylene diamines having the formula:

$RNH(CH_2)_xNH_2$ wherein, in all instances, R and R′ are hydrocarbon radicals containing from 8 to 22 carbon atoms, and x is an integer of from 2 to 6.

3. A composition as described in claim 1 wherein said polydimethylsiloxane anti-foam agent comprises finely divided silica.

4. A composition as described in claim 1 which consists essentially of:

| | Parts By Weight |
|---|---|
| hydrochloric acid | about 10 |
| amine-based inhibitor (including solubilizer) | about 1.0 |
| polysiloxane anti-foam agent | about 1.0 |

the balance being essentially water.

5. A composition as described in claim 1 consisting essentially of:

| | Parts by Weight |
|---|---|
| hydrochloric acid | 7.5 to 25 |
| amine-based inhibitor (including solubilizer) | 0.05 to 2.5 |
| furfural | 0.6 to 2.5 |
| dialkylthiourea wherein the alkyl groups contain up to about 4 carbon atoms | 0.5 to 1.4 |
| benzylthiocyanate | 0.0 to 2.0 |
| polysiloxane anti-foam agent in an amount equal to from 5% to 120% by weight of the amine-based inhibitor; | |

the balance consisting essentially of water.

6. A composition as described in claim 5 wherein components are present in the following approximate proportions by volume:

| | |
|---|---|
| hydrochloric acid | about 10 |
| amine-based inhibitor (including solubilizer) | about 0.3 |
| furfural | about 0.6 |
| diethylthiourea | about 0.6 |
| polysiloxane anti-foam agent | about 0.05 |

the balance being essentially water.

7. A method of removing scale deposit from galvanized, steel or copper surfaces normally in contact with water, which deposit includes at least one alkaline earth metal carbonate, which method comprises contacting said scale deposit with an aqueous composition as described in claim 5, whereby said deposit is dissolved and/or dispersed.

8. A composition as described in claim 1 which consists essentially of:

| | Parts By Weight |
|---|---|
| hydrochloric acid | 7.5 to 25 |
| amine-based inhibitor (including solubilizer) | 0.2 to 5.0 |
| polysiloxane anti-foam agent | 0.01 to 3.0 |

the balance consisting essentially of water.

9. A composition as described in claim 8 wherein the amount of anti-foam agent is from about 10 to about 120% of the weight of said amine-based inhibitor.

10. A method of removing scale deposit from galvanized, steel or copper surfaces normally in contact with water, which deposit includes at least one alkaline earth metal carbonate, which method comprises contacting said scale deposit with an aqueous composition as claimed in claim 9, whereby said deposit is dissolved and/or dispersed.

* * * * *

UNITED STATES PATENT OFFICE

CERTIFICATE OF CORRECTION

PATENT NO. : 4,222,886

DATED : September 16, 1980

INVENTOR(S) : George F. Connelly, Jr.

It is certified that error appears in the above-identified patent and that said Letters Patent are hereby corrected as shown below:

Column 2, line 23, "4,025,35," should be --4,025,359,-- line 25, "tencency", should be --tendency--.

Column 10, line 53, (Claim 10), "9" should be --8--.

Signed and Sealed this

Ninth Day of December 1980

[SEAL]

Attest:

SIDNEY A. DIAMOND

Attesting Officer

Commissioner of Patents and Trademarks